US007784248B2

(12) United States Patent
Andersson

(10) Patent No.: US 7,784,248 B2
(45) Date of Patent: Aug. 31, 2010

(54) METHOD IN HOT FILLING OF FOODS IN A PACKAGING CONTAINER, AS WELL AS AN APPARATUS THEREFOR

(75) Inventor: Bengt Andersson, Malmö (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 34 days.

(21) Appl. No.: 11/918,723

(22) PCT Filed: Mar. 2, 2006

(86) PCT No.: PCT/SE2006/000269

§ 371 (c)(1),
(2), (4) Date: Oct. 18, 2007

(87) PCT Pub. No.: WO2006/112765

PCT Pub. Date: Oct. 26, 2006

(65) Prior Publication Data

US 2009/0071103 A1 Mar. 19, 2009

(30) Foreign Application Priority Data

Apr. 19, 2005 (SE) ..... 0500906

(51) Int. Cl.

| | |
|---|---|
| ***B65B 55/14*** | (2006.01) |
| ***B65B 63/08*** | (2006.01) |
| ***A23L 3/02*** | (2006.01) |
| ***A23L 3/06*** | (2006.01) |
| ***A23L 2/46*** | (2006.01) |

(52) U.S. Cl. ..... 53/425; 53/440; 53/127; 53/167; 426/401; 426/407; 426/412

(58) Field of Classification Search ..... 53/425, 53/440, 467, 167, 127, 565; 99/470; 426/397, 426/399, 401, 408, 410, 412, 407; *B65B 63/08; A23L 2/46*
See application file for complete search history.

(56) References Cited

U.S. PATENT DOCUMENTS 3,476,574 A * 11/1969 Miller et al. ..... 426/407

(Continued)

FOREIGN PATENT DOCUMENTS

EP 0 624 519 A1 11/1994

(Continued)

OTHER PUBLICATIONS

Lund, Barbara M. et al., "The Microbiological Safety and Quality of Food vol. 1," 2000, Aspen Publishers, Gaithersburg, MD, pp. 59-63.*

(Continued)

*Primary Examiner*—Stephen F Gerrity
(74) *Attorney, Agent, or Firm*—Buchanan Ingersoll & Rooney PC

(57) ABSTRACT

A method involving the hot fill of foods in packaging containers constructed from a paperboard laminate comprises the food being filled in the packaging container with at least one component at a temperature of at least 80°, but below 100°, whereafter the packaging containers are closed and sealed and the packaging containers with their food contents are thereafter held hot during a predetermined period of time by contact with a heat holding medium at a temperature of at least 80°, but below 100°. The heat holding medium is present substantially in gas and/or vapour phase. An apparatus involving the hot fill of foods is also disclosed.

24 Claims, 1 Drawing Sheet

U.S. PATENT DOCUMENTS

Figure 1:
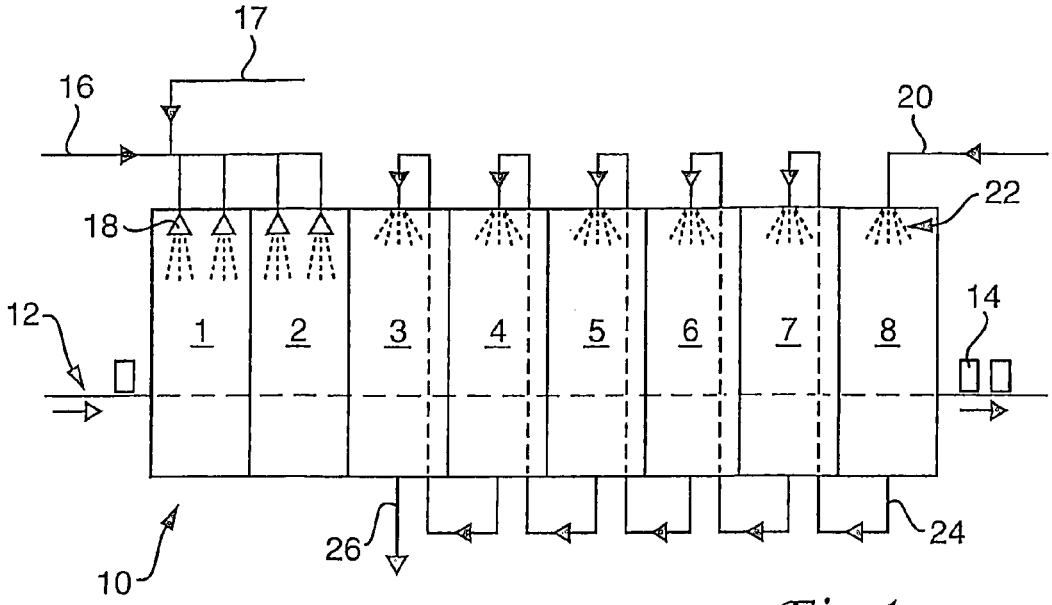

| | | | | |
|---|---|---|---|---|
| 5,242,701 | A * | 9/1993 | Poole | 426/407 |
| 5,421,512 | A * | 6/1995 | Poole | 426/401 |
| 5,494,691 | A * | 2/1996 | Sizer | 53/440 |
| 5,555,702 | A * | 9/1996 | Sizer | 53/127 |
| 5,958,486 | A * | 9/1999 | Ringdahl et al. | 426/399 |
| 6,177,048 | B1 | 1/2001 | Lagerstedt | |
| 7,169,420 | B2 * | 1/2007 | Korengel et al. | 426/407 |
| 2003/0008044 | A1 * | 1/2003 | Lafleur | 426/397 |
| 2003/0207054 | A1 * | 11/2003 | Magnusson | 428/34.2 |
| 2004/0131735 | A1 * | 7/2004 | Korengel et al. | 426/399 |

FOREIGN PATENT DOCUMENTS

| | | |
|---|---|---|
| WO | WO 98/16431 A1 | 4/1998 |

OTHER PUBLICATIONS

International Search Report issued in corresponding International Patent Application No. PCT/SE2006/000269, ISA, Stockholm, SE, May 19, 2006.

* cited by examiner

METHOD IN HOT FILLING OF FOODS IN A PACKAGING CONTAINER, AS WELL AS AN APPARATUS THEREFOR

TECHNICAL FIELD

The present invention relates to a method in the hot filling of foods in packaging containers constructed from a paperboard laminate, said food being filled in said packaging containers with at least one component thereof at a temperature of at least 80° C. but below 100° C., whereafter the packaging containers are closed and sealed and the packaging containers with their food contents are thereafter held heated during a predetermined period of time by contact with a heating medium at a temperature of at least 80° C. but below 100° C.

BACKGROUND ART

Traditionally, preserved foods have been packed in metal or glass containers. However, as a result of technology developed in recent years, it has become possible to pack preserved, i.e. sterile, foods in packaging containers constructed from paperboard laminate, the paperboard laminate being given specific properties with the result that it withstands a sterilising retorting after filling of the food. For example, special qualities of polypropylene are employed for the inner and outer liquid-tight layers of the paperboard laminate. Specific dimensions are also employed for other layers in the packaging laminate as well as choice of qualities which differ from corresponding dimensions and choice of aseptic applications.

From, for example, a flat-folded tubular packaging blank of the prior art known packaging laminate, retortable packaging containers are produced in that the packaging blank is first raised to an open, tubular packaging carton which is sealed at its one end by fold forming and thermosealing of continuous foldable end panels of the packaging carton for forming a substantially planar bottom seal. The packaging carton provided with the bottom is filled with the relevant contents, for example food, through its open end which is thereafter closed and sealed by additional fold forming and thermosealing of corresponding end panels of the packaging carton for the formation of a substantially planar top seal. Naturally, the top seal of the packaging carton may instead be formed first, in which event filling instead takes place via the bottom. The filled and sealed, normally parallelepipedic packaging container is then ready for a heat treatment in order to impart extended shelf-life to the packed contents or food in its unopened packaging container, for example a shelf-life of at least 6 months, often even longer, such as at least 12 or 18 months.

A heat treatment intended to extend shelf-life (retorting) may suitably be put into effect in the manner and under the conditions which are described in international Patent Application carrying publication number WO98/16431. In such instance, the packaging container is placed in a retort and heated therein with the aid of a first gaseous medium flowing in contact with the outer walls of the packaging container, for example hot steam, to a temperature in general within the range of between 70 and 130° C. After a predetermined hold-time at the selected temperature, the supply of the gaseous medium is discontinued. The packaging container is cooled by means of a second circulating gaseous medium, for example cold air, and finally by means of a circulating liquid medium, for example cold water. The cooled retorted packaging container is thereafter removed from the retort for storage, transport and/or other handling.

One variation of such a retorting is so-called hot fill which is particularly utilised for acidic products below a pH of 4.6. In such instance, a filling of the product takes place with at least one component thereof at least 80° C. but below 100° C., entailing a pasteurisation, whereafter retorting is not required because of the fact that the food product is acidic. At least some component of the food product is thus heated to at least 80° C. but below 100° C. already before being filled into the packaging container. In order to ensure sterility, the closed and sealed packaging container is held warm during a predetermined period of time after the hot fill, suitably without the temperature of the packaging container and its food contents being allowed to fall appreciably between hot fill and holding. During the period of holding the food and container, the temperature is maintained at least 80° C. but below 100° C. by contact with hot water flowing over the outer walls of the packaging container. After having been held, the packaging container and its food contents are cooled by means of a coolant which may be cold water.

Within the industry, use is made today of the same type of paperboard laminate for hot fill process of acidic foods as for packaging containers which are retorted. Since no retorting is carried out in connection with a hot fill process, such a paperboard laminate is, however, in actual fact overdimensioned and, consequently, unnecessarily expensive for the hot fill process proper. However, if a simpler paperboard laminate is employed, such as a paperboard laminate with inner and outer liquid-tight layers of polyethylene-based polymer and simpler/more economical qualities also in other layers, the packaging container will become soft and sloppy during the heat holding phase.

It has also proved that problems may arise in connection with the packing of acidic food products in packaging containers formed from paperboard laminate which is particularly adapted for retorting. Such acidic products may be food products containing or packed in acetic acid or other acid, or food products which, during storage, release free fatty acids, which may in particular be the case for food products of the tomato variety. Hereafter, such compounds will be designated acidic compounds regardless of whether they relate to acids such as acetic acid or free fatty acids which have been released from the food product. These acidic compounds have proved to be capable of penetrating the inside of the packaging laminate, but not the aluminium foil. In such instance, they accumulate in steadily increasing concentration adjacent the aluminium foil and gradually, during the long shelf-life which the packaging container nevertheless displays, have a negative effect on the binding or adhesion between the aluminium foil and the liquid-tight inside coating based on polypropylene. In the worst case scenario, there is a risk that the adhesion releases totally so that the inside coating based on polypropylene forms a loose bag inside the packaging container.

BRIEF SUMMARY OF THE INVENTION

One object of the present invention is generally to obviate or at least reduce the above-outlined problems.

Another object is to offer a method in connection with a hot fill process (pasteurisation process), the method permitting the utilisation of simpler paperboard laminates, i.e. paperboard laminates which are not dimensioned for retorting, packaging containers formed from the paperboard laminate nevertheless maintaining their configurational stability during the hot fill and the subsequent heat holding and cooling, and the utilisation of this paperboard laminate also permitting the maintenance of good adhesion or bonding between the oxygen gas barrier of the paperboard laminate and the outer, liquid-tight coating on the inside of the laminate also during a lengthy period of storage, with a content of a food product which contains, is packed in or gives off one or more acidic compounds, for example a food product at a pH of less than 4.6.

Non-restrictive examples of such food products are tomato-based products, acidulated vegetables, picked vegetables, fruits, fruit pulps, vegetable purees, olives, whey and treated cheese, salad dressings, pickled herrings, soups or other ready-to-consume foods of a low pH.

According to the present invention, the problem is solved of, for hot fill of acidic foods, being able to employ a simpler paperboard laminate which permits maintaining the configurational stability of the packaging container during hot fill, heat holding and cooling, at the same time as it permits the maintenance of good adhesion during lengthy storage time of the packaging container filled with the acidic food.

According to the present invention, this is realised in that use is made, in the heat holding at a temperature of at least 80° C. but below 100° C., after hot fill, closing and thermosealing, of a heat holding medium which is substantially present in the gas and/or vapour phase, preferably in the form of hot air.

Thanks to the fact that, in principle, it is merely a matter of maintaining that temperature which the packaging container with its food contents already obtained in connection with the hot fill, no actual thermal transfer is required to the packaging container with its food content. The present invention is based on this insight and that it follows from this that no liquid heat holding medium is required which per se could give better thermal transfer than a heat holding medium which is substantially present in the gas and/or vapour phase. By avoiding such a liquid heat holding medium, a simpler and thereby considerably more economical paperboard laminate can be employed than a paperboard laminate which is dimensioned for retorting. Granted, a minor thermal transfer may be required in order to raise the temperature if it has fallen somewhat after or in connection with the hot fill, but a medium in the gas and/or vapour phase can nevertheless, despite poorer thermal transfer capacity, function satisfactorily for this purpose.

Preferably, said heat holding medium substantially consists of hot air, possibly with an additional heat input in the form of a minor admixture of steam and/or radiation heat. One advantage with a dry heat holding medium, i.e. a heat holding medium with a low vapour content/relative humidity is that the packaging containers need not be oriented in any specific manner during the heat holding period. The explanation for this is that, at higher vapour content, it may be necessary to protect the longitudinal seals (so-called LS seals) of the packaging containers by inverting the packaging containers in such a manner that the longitudinal seals are protected by contact with the substrate. In the employment of drier heat, it is instead possible to allow the packaging containers to stand upright during the heat holding, with the longitudinal seals vertically oriented or oriented in another manner so that they are readily accessible to the heat holding medium.

The temperature of the packaging containers with their food contents should not be permitted to fall more than 15° C., preferably at most 10° C. and even more preferably at most 5° C. between said hot fill and said heat holding. Should such a minor reduction of the temperature take place, the temperature of the packaging containers with their food contents may be raised to at most 80° C. but below 100° C. in a short heating stage which precedes said heat holding, this heating stage also being carried out by contact with said heat holding medium at a temperature of at least 80° C. but below 100° C. That disclosed above also encompasses the case when the temperature has fallen below 80° C. in connection with only some component of the food being at a temperature of at least 80° C. but below 100° C. in the hot fill. Such may, for example, be the case when a solid food material at room temperature or slightly above, such as diced tomatoes or jalapenos or the like, is filled into the packaging container together with a juice which is at a temperature of at least 80° C., but below 100° C.

The heat holding operation proper is carried out during a period of time of up to 30 minutes, preferably from 1 minute and up to 30 minutes, even more preferably from 10 minutes and up to 30 minutes.

According to one aspect of the present invention, the heat holding is carried out in a continuous heat holding tunnel, but it is naturally also conceivable to carry out this operation batchwise.

After the heat holding period, there follows a cooling stage in which the packaging containers and their food contents are cooled, preferably by contact with cold water, to a temperature below 50° C., preferably below 40° C.

A major advantage inherent in the present invention is, as was discussed above, that a simpler paperboard laminate may be employed for the packaging container compared with a paperboard laminate which is conventional for packaging containers which are to be retorted. One paperboard laminate which is suitable for use in connection with the present invention has a core layer of paperboard and is coated with inner and outer layers of a polyethylene based (PE) polymer, preferably a low density polyethylene, and also displays at least one gas barrier layer, such as a layer of aluminium (Al). A couple of non-restrictive examples of paperboard laminate are, seen from the outside and inwards, PE/printwork/paperboard/PE/Al/adhesive/PE or lacquer/printwork/PE/paperboard/PE/Al/adhesive/PE. As adhesive, it may, for example, be appropriate to employ EAA which is a PE based adhesive.

According to another aspect of the present invention, the first, outer liquid-tight coating based on polyethylene on the inside of the packaging laminate has a thickness of between 20 and 60 μm, preferably 25 to 40 μm. The second other liquid-tight coating based on polyethylene on the outside of the packaging laminate has a thickness of between 12 and 50 μm, preferably between 20 and 40 μm.

According to one embodiment of the present invention, an additional layer serving as gas barrier is disposed between the core layer and the aluminium foil, this additional layer serving as gas barrier being directly bonded to said aluminium foil by the intermediary of an interjacent tie layer of, for example, a binder or adhesive, for example an adhesion plastic such as Admer available from Mitsui, Japan. This additional layer serving as gas barrier consists of a material which has been selected from the group essentially comprising polyethylene terephthalate (PET), amorphous polyethylene terephthalate (APET), cyclic olefin copolymers (COC), nylon, polyamide (PA), amorphous polyamide (APA), liquid crystalline polymers (LCP), ethylene vinyl alcohol copolymers (EVOH), silicon oxide (SiOx) and polyvinyl alcohol (PVOH), of which at least the two latter may possibly be applied on a thin carrier layer, such as for example, of paper, OPET, OPA or OPP. Suitably, it may have a thickness of between 5 and 20 μm, preferably between 5 and 15 μm. One or more such gas barrier layers may also be present instead of said layer of aluminium foil, which then, for example, gives a laminate which permits microwave heating.

An additional tie layer of a binder or adhesive, for example an adhesion plastic such as Admer, is applied when necessary between the different layers in the laminate.

All layers in the packaging laminate are of qualities which are particularly suitable for hot fill.

According to one aspect of the present invention, there is also proposed an apparatus in the hot fill of foods in packaging containers constructed from a paperboard laminate, in connection with which apparatus said food is filled in said packaging containers with at least some component thereof at a temperature of at least 80° C., but below 100° C., whereafter the packaging containers are closed and sealed and the packaging containers, with their food contents, are thereafter held warm in the apparatus during a predetermined period of time by contact with a heat holding medium at a temperature of at least 80° C. but below 100° C., the apparatus including means for supplying and maintaining said heat holding medium substantially in the gas and/or vapour phase during the heat holding.

Suitably, the apparatus includes one or preferably more nozzles for the supply of said heat holding medium substantially in gas and/or vapour phase. Preferably, such means supply said heat holding medium in the form of hot air possibly with an additional heat input in the form of a minor admixture of steam and/or radiation heat. For example, the hot air may be heated electrically or directly or indirectly by steam.

The apparatus according to the present invention is naturally insulated in a suitable manner for minimal thermal losses and may be designed according to different embodiments. According to a first embodiment, it is designed as an oven for batchwise heat holding. In such instance, it is also conceivable to utilise equipment which is otherwise used for retorting if such is available. According to another embodiment, the apparatus is instead designed as a continuous tunnel for heat holding comprising one or more endless conveyor belts for the packaging containers. If a plurality of conveyor belts are utilised, these may be disposed in parallel beside one another and/or over one another. According to a third embodiment, the apparatus is designed as a continuous tunnel for heat holding, comprising a through-going path for carriages filled with packaging containers. According to a fourth embodiment, the apparatus is designed with a helical path operative to move the packaging-containers substantially in a helix upwards and/or downwards during the heat holding. Suitably, the packaging containers are first displaced upwards in such a heat holding helical path apparatus in order thereafter to be moved downwards in a subsequent helical path arrangement of the same type but downwardly moving. This embodiment enjoys the advantage of taking up less floor space since it principally extends vertically. Regardless of embodiment, the packaging containers are placed with a slight space between them.

BRIEF DESCRIPTION OF THE ACCOMPANYING DRAWINGS

Figure 2:
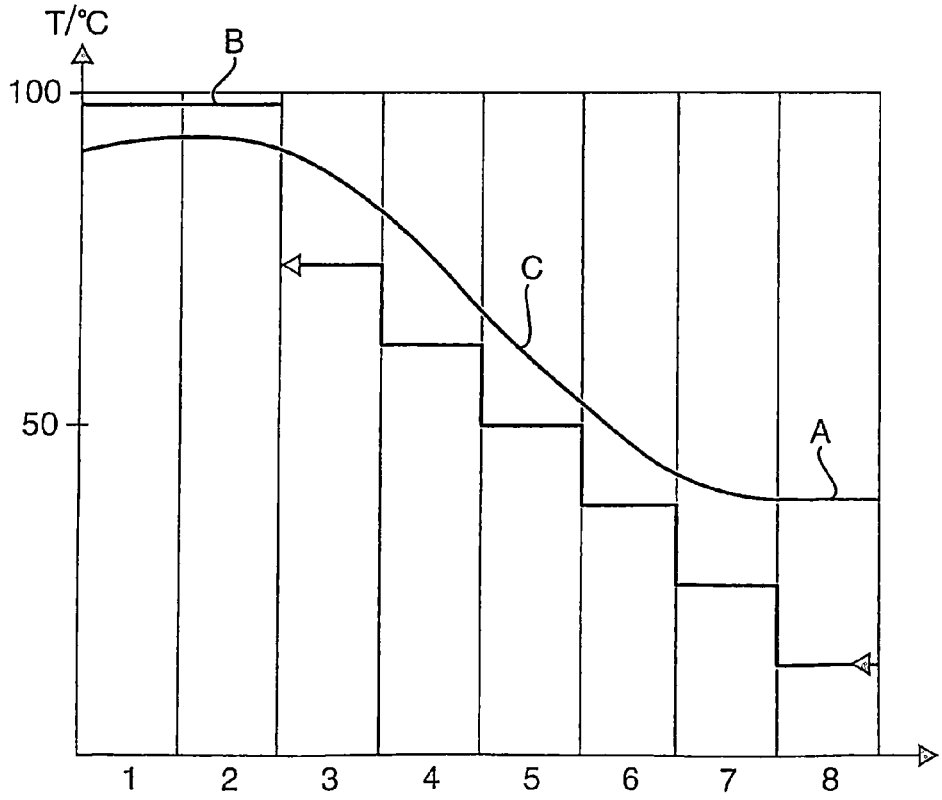

The present invention will now be described in greater detail hereinbelow with reference to the preferred embodiment and with reference to the accompanying Drawings, in which:

FIG. 1 schematically illustrates a continuous tunnel for heat holding and subsequent cooling; and FIG. 2 shows a diagram of temperature profiles of the heat holding medium, the coolant and the packaging containers with their contents, respectively, in the tunnel according to FIG. 1.

DETAILED DESCRIPTION OF FIGURES AND PREFERRED EMBODIMENT

FIG. 1 schematically shows a continuous tunnel 10 for heat holding and subsequent cooling. A conveyor belt 12 leads into an infeed end of the tunnel and out of a discharge end. Suitably, partly sealing curtains (not shown) or the like are disposed at the infeed end and discharge end, respectively. Packaging containers 14 are moved by means of the conveyor belt 12 through the tunnel 10. FIG. 1 shows only three packaging containers, but it should be understood that the conveyor belt is continuously loaded with packaging containers both in the machine direction and in the transverse direction across the conveyor belt. The illustrated embodiment of the tunnel includes eight zones, of which zone 1 and 2 are heat holding zones with means for supplying the heat holding medium which, according to the present invention, is substantially present in the gas and/or vapour phase. Such means may, for example, include conduits 16 and 17, for hot air and steam mixture, respectively, as well as nozzles 18. Zones 3-8 are coolant zones where the included cold water is passed in a conduit 20 to zone 8 in order there to be sprayed 22 over the packaging containers. The water is subsequently accumulated by zone 8 and moved 24 in a similar manner in countercurrent and by means of spraying through the zones 7, 6, 5, 4 and finally zone 3 where it departs from the tunnel through an outlet conduit 26.

It should be realised that innumerable modifications may be put into effect of this tunnel concept, in which event, for example, the number of zones may be different both in total and in respect of heat holding zones and coolant zones, respectively. The flow direction of coolant and heat holding medium may also be arranged otherwise in a manner which will be obvious to a person skilled in the art. As was mentioned above, the tunnel may moreover include a plurality of conveyor belts or alternatively a track or path for carriages loaded with the packaging containers. Other alternatives are an oven for batchwise heat holding or a space-saving helical path.

FIG. 2 shows a diagram of temperature profiles of the heat holding medium, coolant and packaging containers with their contents, respectively, in the tunnel according to FIG. 1. The X axis shows the eight zones and the Y axis shows temperature. Curve A shows the temperature of the coolant water which is passed from zone 8 to zone 3. Curve B is a straight line showing the temperature of the heat holding medium introduced in zone 1 and 2 and curve C shows the resulting temperature in the packaging containers with their food contents.

The present invention is not restricted exclusively to the embodiment described and shown by way of example, a number of different alterations and modifications being possible without departing from the scope of the inventive concept as this is defined by the appended Claims.

The invention claimed is:

1. A method in hot fill of foods in packaging containers constructed from a paperboard laminate, comprising hot filling said food in said packaging containers with at least one component thereof at a temperature of at least 80° C. but below 100° C., thereafter closing and sealing the packaging containers, and thereafter heat holding the packaging containers with their food contents during a predetermined period of time by contact with a heat holding medium at a temperature of at least 80° C. but below 100° C., wherein said heat holding medium is substantially present in gas and/or vapour phase.

2. The method as claimed in claim 1, wherein said heat holding medium is substantially free of liquid phase.

3. The method as claimed in claim 1 wherein said heat holding medium comprises hot air.

4. The method as claimed in claim 1, wherein a temperature of the packaging containers with their food contents is at most permitted to fall 15° C. between said hot filling and said heat holding.

5. The method as claimed in claim 4, wherein the temperature of the packaging containers with their food contents is raised to at least 80° C. but below 100° C. in a heating stage which precedes said heat holding, the heating stage also being carried out by contact with said heat holding medium at temperature of at least 80° C. but below 100° C.

6. The method as claimed in claim 1, wherein said heat holding is maintained during a period of time of up to 30 minutes.

7. The method as claimed in claim 1, wherein said heat holding is carried out in a continuous heat holding tunnel.

8. The method as claimed in claim 1, wherein said heat holding is carried out batchwise.

9. The method as claimed in claim 1, further comprising cooling the packaging containers and their food contents following the heat holding to a temperature below 50° C.

10. The method as claimed in claim 1, wherein said food has a pH of below 4.6.

11. The method as claimed in claim 1, wherein said paperboard laminate is coated with inner and outer coatings of a polyethylene based polymer, and includes a gas barrier layer.

12. The method as claimed in claim 1, wherein the heat holding medium comprises hot air with an additional heat input comprised of at least one of steam and/or radiation heat.

13. The method as claimed in claim 1, wherein a temperature of the packaging containers with their food contents is at most permitted to fall 5° C. between the hot fill and the heat holding.

14. The method as claimed in claim 1, wherein said heat holding is maintained during a period of time from 10 minutes and up to 30 minutes.

15. The method as claimed in claim 1, wherein said heat holding is followed by a cooling stage in which the packaging containers and their food contents are cooled by contact with cold water to a temperature below 40° C.

16. The method as claimed in claim 1, wherein said paperboard laminate is coated with inner and outer coatings of a low density polyethylene, and includes a gas barrier layer.

17. An apparatus used in hot fill of foods in packaging containers constructed from a paperboard laminate, in connection with which apparatus said food is filled into said packaging containers with at least one component thereof at a temperature of at least 80° C. but below 100° C., whereafter the packaging containers are closed and sealed and the packaging containers with their food contents are thereafter subjected to heat holding during a predetermined period of time by contact with a heat holding medium at a temperature of at least 80° C. but below 100° C., wherein said apparatus comprises means in order, during the heat holding, for supplying and maintaining said heat holding medium substantially in gas and/or vapour phase.

18. The apparatus as claimed in claim 17, further comprising at least one nozzle for supplying said head holding medium substantially in gas/or vapour phase.

19. The apparatus as claimed in claim 18, wherein the apparatus is an oven for batchwise heat holding.

20. The apparatus as claimed in claim 17, further comprising means for supplying said heat holding medium as hot air.

21. The apparatus as claimed in claim 20, wherein the apparatus is a continuous tunnel for heat holding, including at least one endless conveyor belt for transporting the packaging containers.

22. The apparatus as claimed in claim 20, wherein the apparatus is a continuous tunnel for heat holding, comprising a through-going path for carriages filled with the packaging containers.

23. The apparatus as claimed in claim 20, wherein the apparatus comprises a helical path operative to move the packaging containers substantially in a helix upwards and/or downwards during the heat holding.

24. The apparatus as claimed in claim 17, further comprising means for supplying said heat holding medium as hot air with a steam admixture and/or radiation heat as an additional heat input.

* * * * *